United States Patent [19]

Iwase et al.

[11] Patent Number: 4,789,261

[45] Date of Patent: Dec. 6, 1988

[54] LIQUID AEROSOL APPLICATOR WITH SPONGE BUFFER TO BRUSH

[75] Inventors: Yasuyuki Iwase, Fujioka; Yoshiaki Akaishi, Saitama; Masaomi Muranishi, Furukawa, all of Japan

[73] Assignee: Mitsubishi Pencil Co., Ltd., Tokyo, Japan

[21] Appl. No.: 33,288

[22] Filed: Apr. 2, 1987

[30] Foreign Application Priority Data

Apr. 3, 1986 [JP] Japan ..... 61-77365

[51] Int. Cl.[4] ..... A46B 11/02

[52] U.S. Cl. ..... 401/190; 401/273; 401/278; 401/280; 401/283; 401/288

[58] Field of Search ..... 401/288, 286, 190, 283, 401/273, 278, 280

[56] References Cited

U.S. PATENT DOCUMENTS

| | | | |
|---|---|---|---|
| Re. 25,585 | 5/1964 | Birch et al. | 401/190 |
| 3,094,130 | 6/1963 | Wiener | 401/190 |
| 3,319,669 | 5/1967 | Abplanalp | 401/190 X |
| 3,572,591 | 3/1971 | Brown | 401/190 X |
| 3,589,824 | 6/1971 | Andrews et al. | 401/206 |

FOREIGN PATENT DOCUMENTS

| | | | |
|---|---|---|---|
| 2580234 | 4/1985 | France . | |
| 557160 | 12/1974 | Switzerland | 401/190 |
| 1105590 | 3/1968 | United Kingdom . | |

*Primary Examiner*—Steven A. Bratlie

*Attorney, Agent, or Firm*—Armstrong, Nikaido, Marmelstein & Kubovcik

[57] ABSTRACT

A liquid applicator composed of a stem cylinder body enclosing a liquid supply vessel, a knocking member at the rear end and a brush part at the top of the outer stem.

The liquid supply vessel is composed of a pressure-tight container having a specific quantitative valve and containing a pressurized liquid which contains a raw liquid and an ejecting agent.

An adapter is interposed betwen an ejecting nozzle of a valve in the liquid supply vessel and the brush part. The liquid is leaked from the brush part by a knocking on the knocking member.

3 Claims, 4 Drawing Sheets

LIQUID AEROSOL APPLICATOR WITH SPONGE BUFFER TO BRUSH

BACKGROUND OF THE INVENTION

1. Field of the Invention

The present invention relates to an applicator for liquid such as an ink, an oil, a cosmetic liquid, etc. Particularly, the present invention related to a so-called aerosol-type liquid applicator which contains a liquid having high viscosity as a raw liquid, such as an ink mainly comprising a pigment in high density, an ink having high viscosity, a quickdryable ink, a cosmetic liquid, a lubricating oil, an adhesive and the like (hereinafter referred to simply as "a liquid").

2. Description of the Prior Art

Hitherto, as an applicator for such a viscous liquid, there is provided various type of the applicators, which include a composite ink type, an ink and pressurized gas type, etc. The composite ink type of the applicator comprises a tube body having a valve means at a brush part, which contains a mixture of an ink and volatile solvent. In the tube body, a pressure due to a evaporation of the volatile solvent is always applied as a part of the liquid mixture so that the ink may be blown out when the valve is opened by, for example, pushing the brush part.

The ink and pressurized gas type of the applicator is composed of a similar structure to that of the composite ink type except that the ink is pressed by pressurized gas which is stored in the tube body separate from the ink.

In the prior known applicator, there is a drawback that if a brush part is too soft to withstand knocking action, a liquid cannot be supplied to the brush part. If a brush part cannot withstand a knocking action to some extent, the brush part may be easily broken.

Regarding a pressurized type prior known applicator, there are also drawbacks such that remaining liquid at the brush part after application is liable to be solidified to harden the brush part. The hardened brush part should be treated with, for example solvent, to soften thereof before next application, which may be a relatively long time.

The liquid such as ink is hard to be supplied throughout the brush part and is liable to form narrow passage in the brush part by dissolving a resin in a specific direction. Under such circumstances, if the ink is suplied excessively, a drop of ink will come out of a brush part as droplets.

Furthermore, when a liquid containing a pigment having large particle size, or having high density is used in the applicator, the pigment may be easily sedimented in the liquid supply vessel after storage thereby requiring a troublesome treatment for redispersing thereof. The pressure of the ejection gas becomes lower if an amount of the liquid bcomes lesser.

The present invention is proposing a new liquid applicator obviating these drawbacks as discussed above.

SUMMARY OF THE INVENTION

According to the present invention there is provided a liquid applicator which comprises a cylindrical stem body having a brush part at a top and a knocking member at a rear end, and a liquid supply vessel having a valve which is detachably assembled in the stem body with an adapter provided between a nozzle of the valve and the brush part, wherein the valve of the liquid supply vessel is capable of being opened by action of the knocking member.

DETAILED DESCRIPTION OF THE INVENTION

Figure 1:
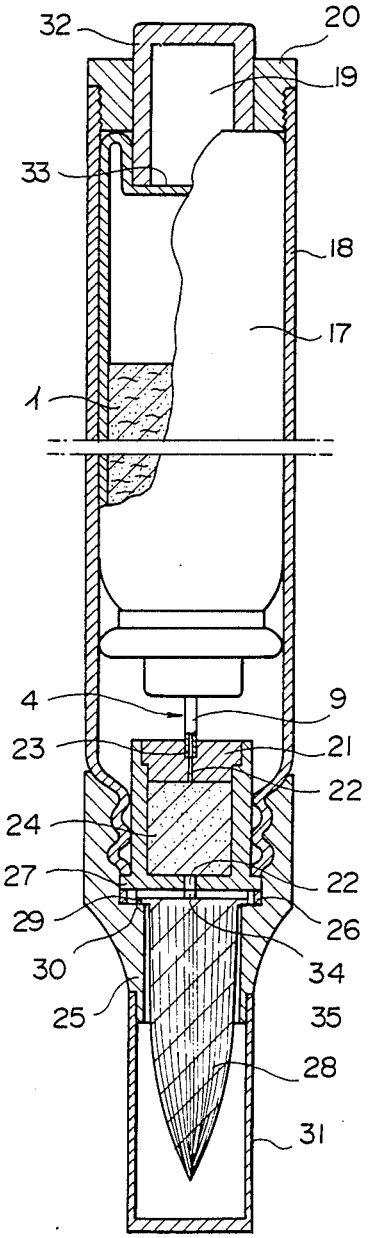
FIG. 1 shows a cross-section of the tube stem according to Examples 1 and 3.

A liquid supply vessel in the liquid applicator of the present invention supplies liquid to the brush part by actuation of the knocking member at a rear end of the stem body. When the knocking member is knocked, a liquid supply vessel is pushed and moved forward thereby counter actively pushing a stem attached to an adapter in order to open the valve. Accordingly, the mixture of the viscous liquid and a solvent is ejected due to a pressure of the solvent supplied to the brush part through a passage in the adapter.

The viscous liquid to be contained in the applicator of the present invention may be selected depending on its utility, and even a high viscous liquid such as those containing a resin in a high concentration, or containing a pigment of high density and the like, may be successively used with an aid of the dispersible force of the ejecting agent or due to a property of the ejecting agent for dissolution and ejection. A viscous liquid for writing or painting comprises, for example, from 5 to 50 parts by weight of a resin such as a nitrocellulose, an acrylic resin, an alkide resin, an urethane resin, a butyral resin, a styrol resin, a natural resin, etc. or a mixture thereof; from 20 to 70 parts by weight of an organic solvent such as an alcohol, hydrocarbons, and ether, an esters, etc. or a mixture thereof; from 0.1 to 10 parts by weight of a colored pigment such as a titanium oxide, a zinc oxide, an iron oxide, a carbon black, an indigo-blue, an aluminum powder, a bronze powder, a synthesized silica flour, etc.; and from 0.01 to 3 parts by weight of additives such as a plasticizer, a dispersant, a sedimentation inhibiter, etc., to form a solution of 100 parts by weight in total.

As for the ejecting agent, a mixture comprising from 15 to 50 parts by weight of a dimethylether, and from 50 to 80 parts by weight of gases such as a liquified petroleum gas, a dichlorofluoromethane, a trichloromonofluoromethane, a dichlorotetrafluoromethane, etc., or a mixture thereof, to form a gas of 100 parts by weight in total, may be used.

A mixture which comprises from 10 to 60 parts by weight of the viscous liquid and from 40 to 90 parts by weight of the ejecting agent to form 100 parts by weight of a mixture in total is charged into a pressure-tight vessel to form a liquid container.

A valve to be assembled in a pressure-tight vessel may be of a conventional type which is capable of ejecting a constant specific amount of a liquid at each time. For example, a pressure tight vessel is preferably constructed as follows. A valve is attached on the vessel through a gasket so that one end of a stem which is used for opening the valve, is projected into a valve housing and the other end of the stem is projected outside of the vessel through a center hole of a mounting cup of the valve. The stem is always pushed outward by a spring which is provided in the housing, wherein a stem orifice which is interconnected between a passage in the stem and the housing is closed by a stem rubber or split washer. At the bottom of the housing a hole to the pressure vessel is also provided. When one end of the stem is pushed against a spring force, the orifice is released from the stem rubber, and an opening of the housing is closed with another end of the stem simultaneously to allow the liquid in the housing to be ejected through the orifice. When the pushing force is released, the stem returns to the initial position to close the orifice with the stem rubber and the liquid runs into the housing through the hole inherently.

An amount of the liquid to be ejected at each knocking is preferably designed from 20 to 200 mg for a writing or a cosmetic liquid such as a manicure.

A liquid supply vessel is formed by assembling the valve on the pressure-tight vessel containing the liquid. At the top of the cylinder which holds the liquid supply vessel, there is provided with a coating member such as a pen-point, a brush, etc. in a conventional manner, which is not limited.

A material of the coating member at the brush part is not limited in terms of forms, property, etc. A soft fibrous material, such as wool, may be available.

An adapter which is placed between the coating member and the valve of the liquid supply vessel is so designed that allowing the liquid passing through a liquid passage in the stem to the brush part, and allowing the vessel taking a position so that the vessel may be attached to the top of the stem. The adapter is to be able to withstand a knocking pressure for supplying the liquid from the vessel. In order to prevent objectionable feeding of the liquid, a buffer to hold the liquid, such as a sponge 24, may be conventionally provided in a passage of the liquid.

A knocking member which is provided at the rear end of the stem body is not restricted with respect to a constitution, provided that it is capable of attaching at the rear end of the liquid vessel and allowing the vessel to push forward. For example, a spring for returning the knocking member may be either commonly used for actuating the valve in the vessel, or exclusively provided.

The applicator of the present invention ejects the liquid by a knocking operation on the knocking member which is provided at the rear end of the stem cylinder. When the knocking member is knocked, the vessel moves forward to push the stem which is attached to the adapter thereby allowing the valve to open to eject the liquid from the vessel with the aid of the ejecting agent to the application part through the passage of the adapter. The ejecting agent which is supplied to the application part with the liquid is almost vaporized and the liquid may be used for application purposes.

A liquid solution is preferably composed of from 10 to 60 parts by weight of the raw liquid and from 40 to 90 parts by weight of the ejecting agent. If the raw liquid is used in an amount of less than 10 parts by weight, the object of the applicator is not attained at all, while if the raw liquid is used in over 60 parts by weight, the liquid cannot be sprayed satisfactorily. On the other hand, if the ejection agent is contained in an amount of less than 40 parts by weight, an ejection cannot be effected satisfactorily, while if the ejecting agent is contained in an amount over 90 parts by weight, the applicator is not attained in its object since the liquid becomes too thin.

As an ingredient of the ejecting agent, a dimethylether is preferably contained in an amount of from 15 to 50 parts by weight since a dimethylether is effective for dissolving hardened ingredients of the liquid at the applicating part or for dispersing the liquid in the vessel. With an amount of less than 15 parts by weight, it does not act as a solvent, while with an amount of over 50 parts by weight it is not desirable due to inflammability.

Other ingredients than dimethylether to be contained in the ejecting agent may be selected so as to be possessed as a pressure controlling aid to maintain an inner pressure of the vessel at 8 Kg/cm or less at 35° C.

A preferable embodiment of the raw liquid comprises from 5 to 50 parts by weight of a resin, from 20 to 70 parts by weight of an organic solvent, from 0.1 to 10 parts by weight of a pigment, and from 0.01 to 3 parts by weight of an additive.

With an amount of less than 5 parts by weight of the resin, the liquid becomes flowable on a coated surface, while with an amount of over 50 parts by weight the liquid is liable to solidify at a brush part and be difficult to redissolve thereof when it is used again.

With an amount of less than 20 parts by weight of an organic solvent, the resin and the pigment may be neither dissolved nor dispersed while with an amount of over 70 parts by weight, the liquid becomes liable to flow on a coating surface.

With an amount of less than 0.1 parts by weight of the pigment the desired color may not be obtained, while with an amount of over 10 parts by weight the pigment is too much to obtain the desired color. Accordingly, the additives should be inherently within the weight range as specified above.

When the applicator of the present invention is to be used as a writing instrument, or a cosmetic brush, an amount of the liquid to be ejected each time is preferably in a range of from 20 to 200 mg. With an amount of less than 20 mg of the liquid, it is not enough to accomplish an object and requires several knockings, while with an amount of over 200 mg, the liquid is sprayed with so strong a force that the sprayed liquid may be unpreferably dispersed to contaminate the entire area.

An adapter which is placed between the valve of the liquid vessel and the brush part, must so function that the liquid supplied from the vessel may be buffered. If a material, such as a sponge, is placed in a liquid passage, the buffer becomes more effective.

A valve of the present invention is illustrated in more detail in the attached drawings.

Figure 3:
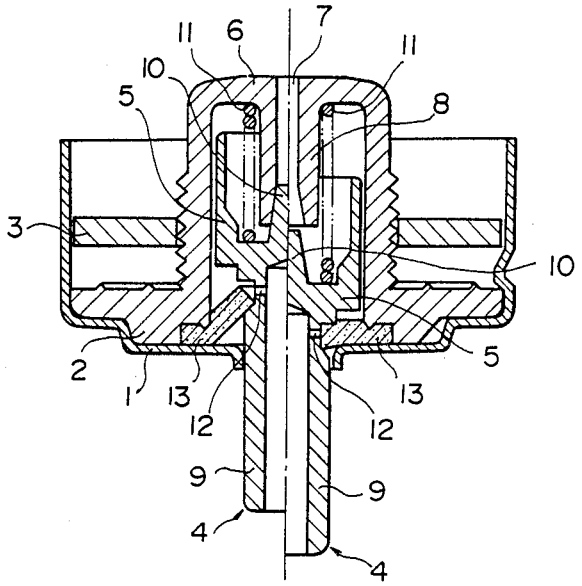
FIG. 3 shows a cross-section of the valve portion of the liquid supply container according to Examples 1, 2 and 3 with the right and left-hand section halves illustrating a different position of the valve parts.

In FIG. 3, a mounting cup 1, which is secured in a housing 2, is fixed on a neck of a pressure-tight vessel or liquid reservoir, not shown, having an open end. A gasket 3 is placed between the housing 2 and the neck part of the pressure-tight vessel. The housing 2 has an inner cavity capable of receiving a base part 5 of a stem 4 as will be explained more fully hereunder, and a cylindrical valve seat 8 which is provided with a passage hole 7 interconnected with the pressure-tight vessel at the bottom 6 thereof. The stem 4 has a cylindrical top part 9 which is projected outwardly through a center hole of the front face of the mounting cup and has an opening at the top, and a base part 5 which is to be inserted into the inside of the housing 2. At the base part 5, a valve rod 10 is detachably inserted into the cylindrical valve seat 8 in the housing 2 to maintain the valve seat 8 in an open state by withdrawing therefrom the valve seat with the aid of a coil spring 11 provided between the base part 5 and the bottom face 6 of the housing 2 (refer to the left half part of FIG. 3). At this state, a stem orifice 12 formed in close proximity of the base part of the top cylindrical part 9 of the stem 4, kept in a closed state with stem rubber 13 which is secured between the top face of the mounting cup 1 and the housing 2. Said valve is opened by releasing the stem rubber 13 from the stem orifice 12 when the top of the stem is pushed downward with respect to the housing 2. Simultaneously, the valve rod 10 closes the valve seat 8 (refer to the right half part of FIG. 3) so that the liquid in a vacant cavity in the housing 2, may be ejected through the stem orifice 12. Thus, the amount of the liquid to be ejected is dependent on the cavity volume in the housing 2 and is constant.

Figure 4:
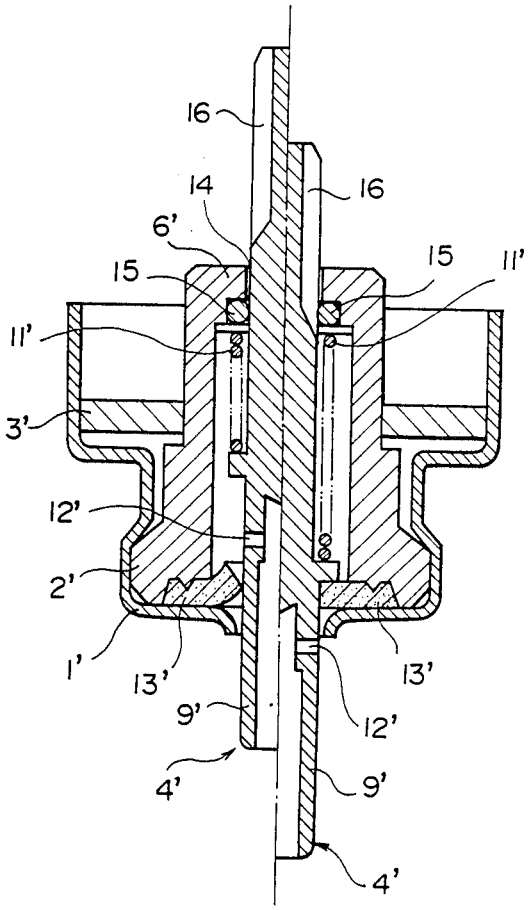
FIG. 4 PRIOR ART
FIG. 4 shows a cross-section of the prior known valve with the right and left-hand section halves illustrating a different position of the valve parts.

A detail of a quantitative type valve which is widely used in commercial application may be explained by referring to the attached FIG. 4.

To a mounting cup 1', which is to be attached to a pressure-tight vessel (not shown), a housing 2', a gasket 3' and the stem rubber 13' are assembled together as similar to the valve of FIG. 3. However, the housing 2' does not provide the valve seat 8 of FIG. 3, but provides the O-ring 15 at passage hole 14 through which a rod like stem 4' penetrates. The O-ring is also attached with an outer surface of the stem 4' which forms liquid passage groove 16 on its outer surface. A coil spring 11' is also placed between the stem 4' and a bottom face 6' of the housing 2' to maintain the stem so that both ends of the passage groove 16 may be positioned at each side of the O-ring respectively, in a free state due to compression of the coil spring 11' to let the liquid pass through from the inside of the housing to the pressure-tight vessel. In this position, a stem orifice 12' formed at the top cylinder part 9' of the stem 4' is projected out of the mounting cup 1', and is not in a contacting state with the stem rubber 13' (refer to the left half part of FIG. 4). When the top of the stem 4' is pushed downward with respect to the housing 2, the stem 4' moves downwards to project the passage groove 16 on the stem 4' outside of the O-ring 15 thereby closing a passage from the vacant cavity of the housing to the pressure-tight vessel. The stem orifice 12' is pushed inside the housing 2', the stem rubber thereby opening a passage from the vacant cavity of the housing to the outside of the applicator to eject a specific amount of the liquid in the housing.

The present invention is further explained more in detail by way of the working examples, which are not intended to limit the scope of the present invention. Percents shown in the examples are based on the weight.

EXAMPLE 1

A raw liquid of a silver ink was formed with a resin comprising 8 parts by weight of SS ½ type nitrocellulose which was dissolved in 30% alcohol, and 10 parts by weight of an acryl resin; an organic solvent comprising 4 parts by weight of an ethylacetate, 15 parts by weight of triol and 1 part by weight of a butyl cellusolve; and a pigment 2 parts by weight of aluminum powder.

An ink liquid was prepared by adding an injecting agent comprising 15 parts by weight of dimethylether and 45 parts by weight of dichlorotetrafluoromethane, into the raw liquid and charged in a pressure-tight vessel. A valve as shown in FIG. 3 was assembled on a container to form a liquid vessel, which was placed in a stem cylinder body as shown in FIG. 1.

In FIG. 1, an outer cylinder 18 encloses the liquid supply vessel 17 detachably along an axial direction, and provides a tail plug 20 having a center hole 19 detachably at a rear end thereof. The liquid supply vessel may be freely removed for replacing from the rear opening of the outer cylinder 18. An adapter 21 is placed in the outer cylinder 18 at the top thereof, and has a passage hole 23 from liquid passage to the valve stem in the liquid vessel 17. In the intermediate passage 22 a sponge 24 having continuous pores is placed. Said adaptor 21 is fixed at a top of the outer cylinder 18 by interposing a flange part 27 thereof between a brush receiver 26 and the outer cylinder 18. The brush receiver is attached to an inner step of front shaft 25 which is fastened with screw threads at the top of the outer cylinder 18. In a concave surface of a front face in the brush receiver 26, a rear flange part 29 of the brush part 28 is placed, and the brush part 28 is secured by interposing a flange part 29 between an inner step 30 of a front shaft 25 and the brush receiver 26. At an outer top part of the front shaft 25, a cap 31 to cover over the brush part 28 is detachably provided. An outside diameter of cap 31 is little smaller than the inside diameter of the center hole 19 in a tail plug 20, therefore, the cap 31 may freely pass through the center hole 19. When the liquid supply vessel 17 is assembled in the outer cylinder 18, the top of the stem 4 is inserted water-tightly into the passage hole 23 of the adapter 21 to complete the passage 22 from the front cylinder part 9 of the stem 4 to the adapter 21. The liquid supply vessel 17 is fixed by attaching a front face of the tail plug 20 against the rear end thereof.

The applicator having such a construction is practically applied as follows.

After taking cap 31 off from the front shaft 25 and taking the plug body 32 out of the center hole 19 in the tail plug 20, the cap 31 is inserted into the center hole 19 in the tail plug 20 so as to engage and fit the top thereof with the rear concave part 33 of the liquid supply vessel 17.

Then, on knocking the cap 31, the liquid supply vessel 17 moves forward thereby counteractively moving the stem 4 backward with respect to the liquid supply vessel body since the stem 4 is positioned at the front part of the liquid supply vessel and is fixed by attaching to the adapter 21. The movement of the stem 4 makes the stem orifice 12 free from the stem rubber 13 to eject the specific amount of the liquid in the cavity of the housing 2 to the front cylinder part 9 through the orifice 12.

The liquid ejected then passes through the passage 22, the sponge body 24, and a passage hole 30 and groove 35 in the brush receiver 26 to the brush 28.

EXAMPLE 2

A raw manicure liquid was prepared with a resin comprising 5 parts by weight of SS ½ type nitrocellulose, which was dissolved in 30% alcohol, and 7 parts by weight of an acryl resin; an organic solvent comprising 5 parts by weight of ethyl acetate, 3 parts by weight of butyl acetate and 28 parts by weight of triol; a pigment comprising 0.5 parts by weight of titanium oxide and 0.05 parts by weight of Lake Red BAO; and an additive comprising 0.95 parts by weight of a plasticizer. A manicure liquid was prepared by adding an injecting agent comprising 20 parts by weight-of dimethyl ether, 25 parts by weight of trichloromonofluoromethane and 5 parts by weight of dichlorodifluoromethane, into the raw manicure liquid, and charged in a pressure-tight container. A valve as shown in FIG. 3, was assembled on the container in the same manner as in Example 1 to form a liquid vessel, which was placed in a stem cylinder body was shown in FIG. 2.

Figure 2:
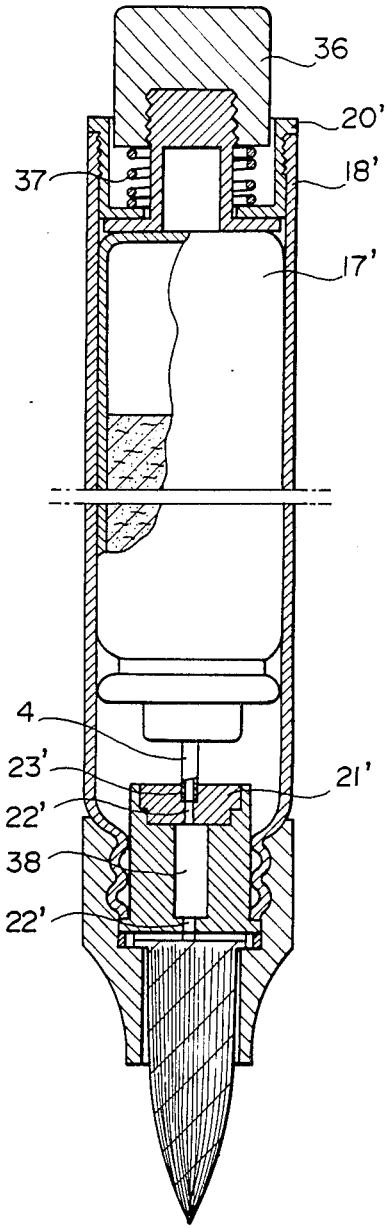
FIG. 2 shows a cross-section of the tube stem according to Example 2.

In FIG. 2, the knocking member 36 is exclusively provided without utilizing a coil spring 11 for setting the valve of the liquid supply vessel 17. The knocking member 36 is placed at the rear end part of the outer cylinder 18' so as to be attached with the back face of the liquid supply vessel 17', and an exclusive coil spring 37 for setting the knocking member back to the initial position is provided between the tail plug 20' and the bottom of the knocking member 36. In an adapter 21' provided at the top of the outer cylinder 18', a vacant room 38 is formed at the middle of the liquid passage 22' without providing with the sponge body.

In the adapter 21', the inserting hole 23' is of course provided for the stem 4. Other portions of the structure are the same as those in FIG. 1.

EXAMPLE 3

A raw clear coat liquid was prepared by mixing with a resin comprising 12 parts by weight of butyral resin and 3 parts by weight of resin; an organic solvent comprising 20 parts by weight of xylol and 15 parts by weight of triol; and an additive comprising 5 parts by weight of a soybean oil. A clear coat liquid was prepared by adding an injecting agent comprising 10 parts by weight of dimethylether and 25 parts by weight of a liquid petroleum oil gas (butane), into the raw clear coat liquid, and charged in a pressure-tight container. A valve as shown in FIG. 3 was assembled on the container, in the same manner as in Examples 1 and 2 to form a liquid vessel, which was placed in a stem cylinder body as shown in FIG. 1 in the same manner as in Example 1.

The construction of the application is as shown in Example 1.

What is claimed is:

1. A liquid applicator which comprises:

(a) a cylindrical stem body having a knocking member at its rear end;

(b) a brush point having a plurality of fibers tapering to a point and detachably mounted in said stem body and projecting therefrom;

(c) a liquid supply vessel detachably assembled in said stem body, said vessel having a valve capable of being opened by said knocking member, said vessel also having a liquid propellant under pressure to force the liquid therefrom;

(d) said valve being of the type to cause a flow of a metered quantity of liquid therethrough on each operation of said knocking member;

(e) an adapter to connect said valve to a sponge buffer in a cavity in the stem body; and (f) a passage to conduct liquid from said buffer to said brush point, whereby pushing the knocking member causes a measured quantity of liquid to flow to said brush point for application.

2. The liquid applicator according to claim 1, wherein the liquid is an ink.

3. The liquid applicator according to claim 1, wherein the liquid is a cosmetic liquid.

* * * * *